US011490704B2

(12) United States Patent
Soresina et al.

(10) Patent No.: US 11,490,704 B2
(45) Date of Patent: Nov. 8, 2022

(54) ELECTRIC HAIRDRYER

(71) Applicants: Claudio Soresina, Coldrerio (CH); Flavio Soresina, Mendrisio (CH)

(72) Inventors: Claudio Soresina, Coldrerio (CH); Flavio Soresina, Mendrisio (CH)

(73) Assignee: LIGO PATENTS SA, Ligornetto (CH)

( * ) Notice: Subject to any disclaimer, the term of this patent is extended or adjusted under 35 U.S.C. 154(b) by 142 days.

(21) Appl. No.: 17/262,050

(22) PCT Filed: Jul. 23, 2019

(86) PCT No.: PCT/IB2019/056277
§ 371 (c)(1),
(2) Date: Jan. 21, 2021

(87) PCT Pub. No.: WO2020/026072
PCT Pub. Date: Feb. 6, 2020

(65) Prior Publication Data

US 2021/0307475 A1 Oct. 7, 2021

(30) Foreign Application Priority Data

Jul. 30, 2018 (IT) ..... 102018000007605

(51) Int. Cl.
*A45D 20/12* (2006.01)

(52) U.S. Cl.
CPC ..... *A45D 20/12* (2013.01)

(58) Field of Classification Search
CPC ... A45D 20/12; A45D 20/00; A45D 2210/205
(Continued)

(56) References Cited

U.S. PATENT DOCUMENTS 2,042,592 A * 6/1936 Ducart ..... A45D 20/22 392/380
2,425,056 A * 8/1947 Younger ..... A45D 20/22 34/99

(Continued)

FOREIGN PATENT DOCUMENTS

CH 588535 6/1977
DE 3540990 5/1987

(Continued)

OTHER PUBLICATIONS

International Search Report and written opinion issued by the EPO for PCT/IB2019/056227 dated Nov. 14, 2019.

(Continued)

*Primary Examiner* — Stephen M Gravini
(74) *Attorney, Agent, or Firm* — Silvia Salvadori

(57) ABSTRACT

An electric hairdryer (1) comprising an electric motor (2) for an electric hairdryer provided with a motor shaft (2*a*) rotatable around a rotation axis (X), a fan (3) combined with the motor shaft (2*a*) having a base portion (3*a*) and a head portion (3*b*) opposite the base portion (3*a*), a protecting device (4) of the electric motor (2) comprising at least one barrier element (4*a*); an internally hollow containing element (4*b*). The electric motor (2) comprises a zone (2*b*) facing the fan (3) wherein the motor shaft (2*a*) extends along the rotation axis (X); this zone (2*b*) identifying a radial plane (P). The protecting device (4) is partially placed around the rotation axis (X) at a distance from the base portion (3*a*) of the fan (3) greater than or equal to a distance (D) between the base portion (3*a*) of the fan (3) and the radial plane (P).

13 Claims, 7 Drawing Sheets

(58) Field of Classification Search
USPC ..... 34/95–100
See application file for complete search history.

(56) References Cited

U.S. PATENT DOCUMENTS

| | | | | | |
|---|---|---|---|---|---|
| 3,046,673 | A * | 7/1962 | Nawroth | A45D 20/22 | 34/100 |
| 3,220,119 | A * | 11/1965 | Jepson | A45D 20/18 | 34/283 |
| 4,021,930 | A * | 5/1977 | Churas | A45D 20/24 | 132/212 |
| 4,523,080 | A | 6/1985 | Bolton | | |
| 4,835,879 | A | 6/1989 | Egelstad | | |
| 5,568,691 | A * | 10/1996 | Rubin | A45D 20/16 | 392/380 |
| 8,302,324 | B1 * | 11/2012 | Connelly | A45D 20/12 | 132/118 |
| 8,478,115 | B2 * | 7/2013 | Soresina | H01R 35/04 | 392/380 |
| 9,675,158 | B2 * | 6/2017 | Soresina | A45D 20/12 | |
| D929,037 | S * | 8/2021 | Soresina | D28/13 | |
| 2003/0150126 | A1 | 8/2003 | Chang et al. | | |
| 2016/0207063 | A1 | 7/2016 | Sabbatini | | |
| 2021/0307475 | A1 * | 10/2021 | Soresina | A45D 20/10 | |
| 2022/0007809 | A1 * | 1/2022 | Wang | A45D 20/12 | |

FOREIGN PATENT DOCUMENTS

| | | | | |
|---|---|---|---|---|
| DE | 10053338 | | 5/2002 | |
| EP | 0260371 | | 3/1988 | |
| EP | 1926406 | | 6/2008 | |
| JP | S51111158 | | 10/1976 | |
| KR | 1039635 | B1 * | 6/2011 | A45D 20/12 |
| WO | 2007028726 | | 3/2007 | |
| WO | WO-2009109820 | A1 * | 9/2009 | H01R 35/04 |
| WO | WO-2020026072 | A1 * | 2/2020 | A45D 20/10 |

OTHER PUBLICATIONS

International Search Report and written opinion issued by the EPO for PCT/EP2006/065678 dated Apr. 4, 2007.

* cited by examiner

ELECTRIC HAIRDRYER

This application is a U.S. national stage of PCT/IB2019/056277 filed on 23 Jul. 2019, which claims priority to and the benefit of Italian Application No. 102018000007605 filed on 30 Jul. 2018, the contents of which are incorporated herein by reference in their entireties.

The present invention concerns an electric hairdryer.

In particular, the present invention concerns an electric hairdryer provided with a protective element which prevents foreign bodies from being captured inside the hairdryer during operation. Also more in particular, the present invention concerns an electric hairdryer for professional hair styling applications provided with a protective hair-capturing element.

At the state of the art, there are hairdryers both for domestic and professional use which have a protective grid at the back portion of the hairdryer, where the air that is then heated and accelerated towards the outlet mouth is usually sucked in.

The aforesaid protective grid is known to prevent the intrusion of objects, such as hair, or even the fingers of a user since the fan is in fact at the back portion of the hairdryer.

In more detail it is known that, especially in professional use, the outlet mouth of the hairdryer is temporarily plugged or partly obstructed by the user when the locks of hair are typically neared thereto for hair setting.

This type of maneuver, sometimes necessary depending on the type of use of the hairdryer, causes a temporary depression inside the hairdryer, generally in the area between the electric motor and fan, significantly increasing the possibility of intrusions of hair inside the hairdryer and the consequent entrapment of the latter around the motor shaft.

Hairdryers of the known type have at least one important limitation, i.e. they are not provided with further protections, nor with protections for this type of circumstance, i.e. of sucking in hair when the air delivery mouth is obstructed.

The possibility that a temporary depression allows the intrusion of hair or other elements inside the hairdryer causes the mobile parts thereof to quickly deteriorate due to the winding of hair around the motor shaft with which the fan is coupled, in addition to also covering the fan itself with impurities and deposits which compromise its aerodynamic performances.

A further limitation of hairdryers of the known type is that the maintenance is sometimes laborious since it involves the disassembling of almost all of its elements in order to carry out an accurate and in-depth cleaning of the mobile parts at least.

It should also be noted that, at the state of the art, some hairdryer models, especially for professional use, are provided with only one netting system to restrain hair at the inlet of the suction fan and with a fairing to protect the hub of the fan itself.

However, also with this combined netting and fairing solution, hair is not prevented from being sucked inside the body of the hairdryer itself.

The finding of the present invention overcomes the aforesaid limitations.

The present invention concerns an electric hairdryer both for domestic and professional use, comprising an electric motor for an electric hairdryer provided with a motor shaft rotatable around a rotation axis X.

In more detail, the hairdryer of the present invention comprises a fan operatively combined with the aforesaid motor shaft and configured to generate an air flow F. In particular, the fan preferably has a base portion and a head portion opposite the base portion and a supporting body extending between the two head and base portions. The fan of the present finding further has at least one blade combined with the supporting body and configured to generate the air flow F.

The hairdryer further comprises a protecting device of the electric motor comprising at least one barrier element configured to intercept unwanted objects inside said hairdryer.

An internally hollow containing element, and with an opening adapted for housing at least partially the electric motor, is comprised in the aforesaid protecting device.

In an operative working configuration, the electric motor of the hairdryer comprises a zone facing the fan wherein said motor shaft comes out of the aforesaid electric motor to extend along the rotation axis X.

The aforesaid zone of the motor identifies a radial plane P.

Advantageously, the protecting device is at least partially placed around the rotation axis X at a distance from the base portion of the fan greater than or equal to a distance D between the base portion of the fan and the aforesaid radial plane P.

In other words, the fan has a distance between the base portion and the head portion which is less than or equal to the distance D between the fan and the radial plane P.

In more detail, the radial plane P is substantially orthogonal to said rotation axis X of the motor shaft and passes at a flanged portion of said zone of said electric motor in an operative working configuration of said hairdryer.

Preferably, the flanged portion of the zone of the motor is configured to abut in a respective portion of the inner cavity of the containing body in an operative working configuration of the hairdryer.

Preferably, the protecting device is configured so that the containing element is interposed between the barrier element and the electric motor in a radial direction with respect to the rotation axis X, in an operative working condition of the hairdryer.

According to the present invention, the containing element is configured to axially keep apart at least the barrier element from the base portion of the fan along the rotation axis X at a distance greater than or equal to the distance D between the base portion of the fan and the radial plane P in an operative working configuration of the hairdryer.

More in detail, the barrier element is ring-shaped with a central hole so as to allow at least the partial passing of the containing element.

In an embodiment of the present invention, the barrier element and the containing element are two distinct elements and wherein the containing element has a supporting abutment configured to support the barrier element.

According to the aforesaid embodiment, the base portion of the fan preferably has a diameter D2 greater than the diameter of the head portion and wherein at least the barrier element has an outer diameter D1 between a minimum value of about 20% less than the diameter D2 of the base portion and a maximum value of about 20% more than the diameter D2 of the base portion.

Preferably, the barrier element is arranged at a predetermined distance d from the base portion of the fan. Still more preferably, the aforesaid distance d is between about 2 and 0.1 cm.

In particular detail, without any limitation for the present invention, the barrier element has a shape slightly tapering from a smaller portion facing the base portion of the fan to a bigger portion facing the electric motor.

According to the present embodiment, the barrier element has at least one hole along the ring-shaped portion, preferably the barrier element having a plurality of through holes so as to form a grid.

In a further embodiment of the present invention, the protecting device is configured so that the barrier element and the containing element are made in one piece in a single monolithic element.

In particular, the barrier element preferably has an axisymmetric and conical shape tapering from a diametrically smaller portion facing the electric motor to a diametrically bigger portion facing the base portion of the fan.

The barrier element has a plurality of hooked protrusions so as to radially extend outwardly. Preferably, the hooked protrusions are angularly equispaced.

In alternative, without any limitation for the present invention, the barrier element has at least one circular sector having an opening so as to extend about 30° angularly, preferably 20°, with respect to the rotation axis X to allow the outflow of air and to protect the hairdryer from the intrusion of hair in an operative working condition thereof.

According to a further and different embodiment of the present invention, the hairdryer further comprises a containing shell wherein at least the protecting device is configured to be reversibly hooked to the containing shell and wherein the protecting device can be defined by means of a passage port between the containing element and an inner wall of the aforesaid containing shell. This way, the protecting device is placed at a distance from the fan greater than or equal to a distance D between the fan itself and the radial plane P.

The detailed description of the present invention is provided with reference to the accompanying FIGS. 1A-6B, which also have a purely illustrative and thus non-limiting purpose, in which.

It should be noted that some parts of the hairdryer 1 according to the present invention are schematically depicted in the accompanying FIGS. 1A-6B of the present detailed description, whereas some parts were concealed to make others more visible.

The present invention concerns an electric hairdryer 1, both for domestic and professional use, which comprises a dedicated electric motor 2. By way of example and without limitations, the hairdryer 1 is schematically shown in some embodiment variants included in the inventive concept of the finding, such as for example shown in FIGS. 5 and 6A and 6B.

The aforesaid electric motor 2 is provided with a motor shaft 2*a* rotatable around a rotation axis X.

In more detail, the hairdryer 1 of the present invention comprises a fan 3 operatively combined with the aforesaid motor shaft 2*a* and configured to generate an air flow F. The fan 3 is rotatable with respect to the rotation axis X. Preferably, the fan 3 is of the centrifugal type.

In particular, the fan 3 preferably has a base portion 3*a* and a head portion 3*b* opposite the base portion 3*a* and has a supporting body 3*c* extending between the two head 3*a* and base 3*b* portions. The fan 3 of the present invention further has at least one blade 3*d* coupled on the supporting body 3*c* and configured to generate the air flow F.

The hairdryer 1 further comprises a protecting device 4 of the electric motor 2 comprising at least one barrier element 4*a* configured to intercept unwanted objects inside the hairdryer 1.

By way of example and without limitations, unwanted objects means hair, dust, small segments of fabric of another material which could accidentally penetrate a suction grid of the hairdryer 1.

An internally hollow containing element 4*b*, and with an opening 4*c* adapted for housing at least partially the electric motor 2, is comprised in the aforesaid protecting device 4.

Figure 1A:
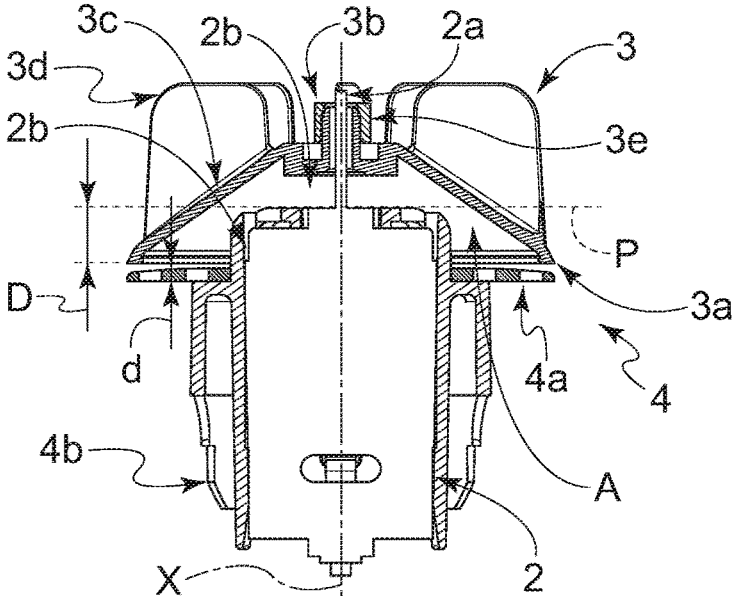
FIG. 1A is a schematic side view of a hairdryer according to the present invention.
Figure 2:
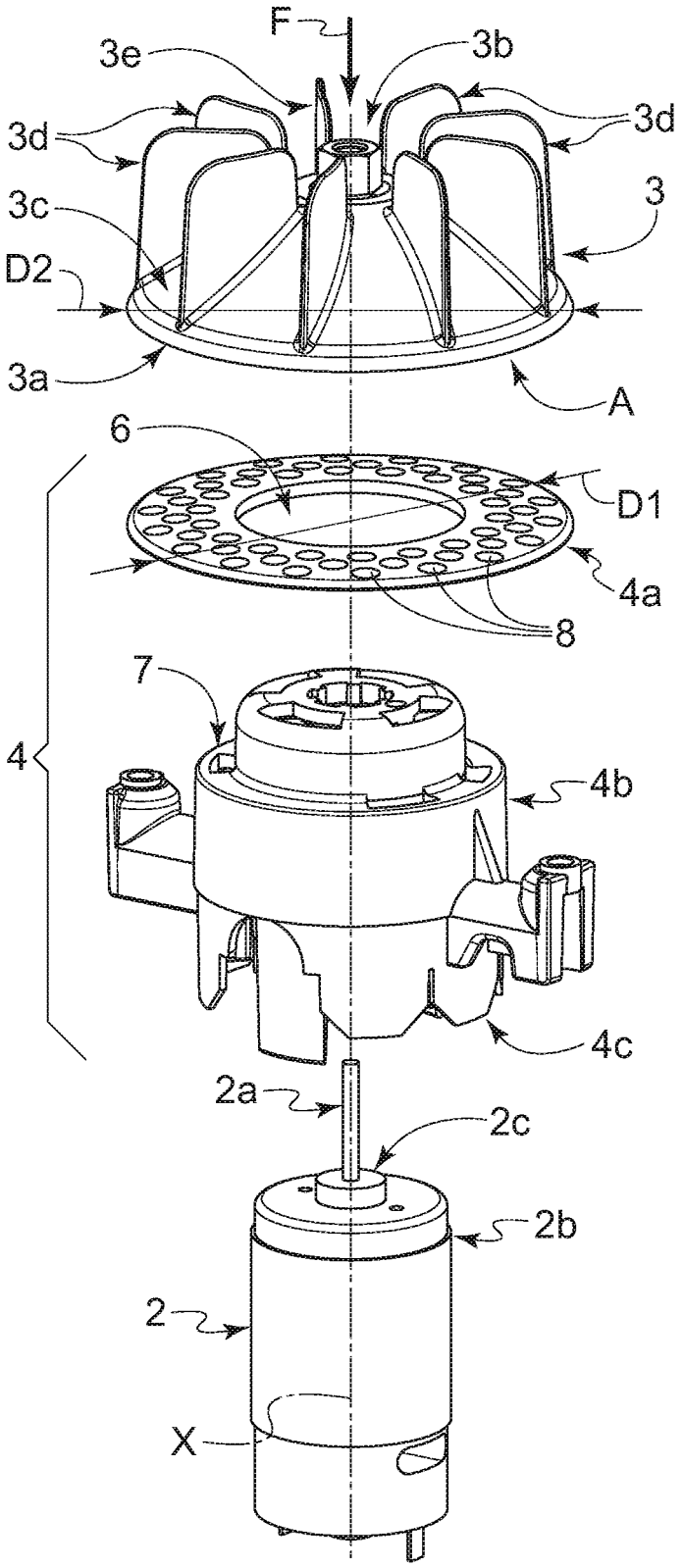
FIG. 2 is an exploded schematic view of the hairdryer of FIG. 1A.
Figure 3A:
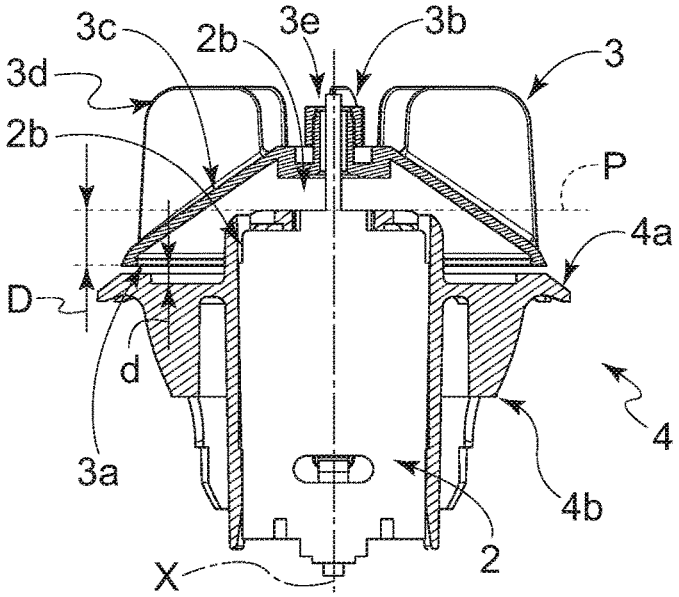
FIG. 3A is a schematic side view of a further hairdryer according to the present invention.
Figure 3B:
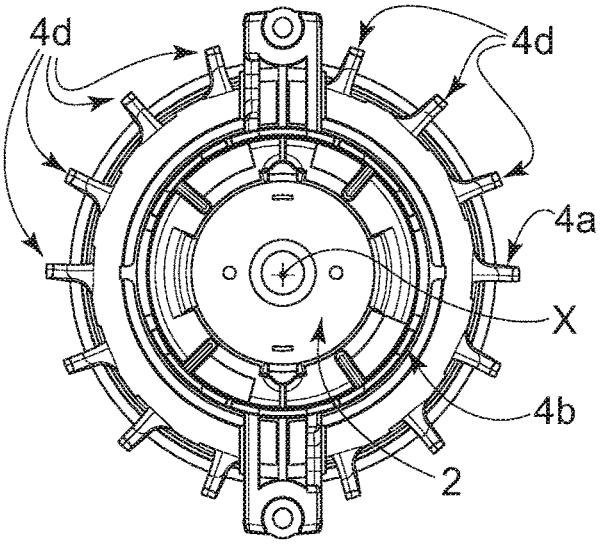
FIG. 3B is a schematic plan view of the hairdryer of FIG. 3A.
Figure 3C:
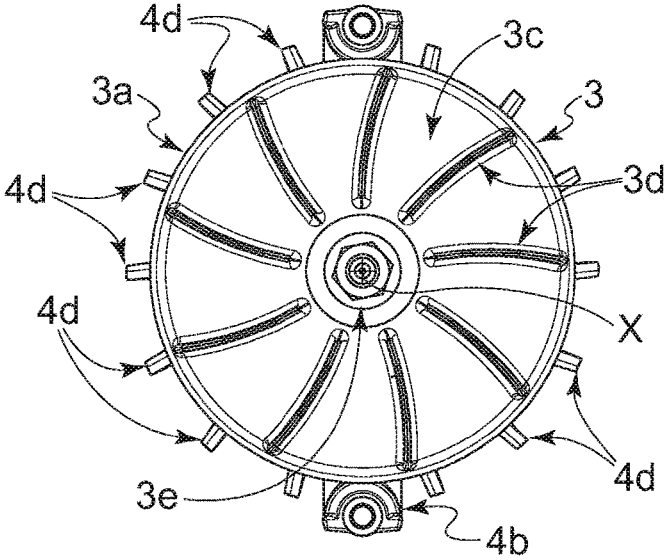
FIG. 3C is a further schematic plan view of the hairdryer of FIG. 3A.

In an operative working configuration, with reference to FIG. 1A or 2 annexed, the electric motor 2 of the hairdryer 1 comprises a zone 2*b* facing the fan 3 wherein the motor shaft 2*a* comes out of the aforesaid electric motor 2 to extend along the rotation axis X.

The zone 2*b* of the aforesaid electric motor 2 identifies a radial plane P. In other words, a radial plane P such as to extend around the rotation shaft 2*a* of the electric motor 2 is identified in parallel to and at the zone 2*b*.

Preferably, at the zone 2*b*, the electric motor 2 comprises a ball bearing or bushing 2*c* to guide the motor shaft 2*a*.

According to the present invention, now with reference to the accompanying FIG. 1A, the protecting device 4 is at least partially placed around the rotation axis X at a distance from the base portion 3*a* of the fan 3 greater than or equal to a distance D between the base portion 3*a* of the fan 3 and the aforesaid radial plane P.

In other words, the fan 3 has a distance between the respective base portion 3*a* and head portion 3*b* which is less than or equal to the distance D between the fan 3 and the radial plane P.

In more detail, the radial plane P is substantially orthogonal to the rotation axis X of the motor shaft 2*a* and passes at a flanged portion of the zone 2*b* of the electric motor 2 in an operative working configuration of the hairdryer. In other words, by way of example and without limitations, in order to better define the aforesaid zone 2*b*, de facto it can be assimilated to the flanged portion of the electric motor 2, as schematically shown in the accompanying FIG. 2.

Preferably, the flanged portion of the zone 2*b* of the motor 2 is configured to abut in a respective portion of the inner cavity of the containing body 4*b*, in an operative working configuration of the hairdryer.

Preferably, the protecting device 4 of the hairdryer 1 is configured so that the containing element 4*b* is interposed between the barrier element 4*a* and the electric motor 2 in a radial direction with respect to the rotation axis X.

Thus, preferably and consequently, the barrier element 4*a* is operatively combined with the electric motor 2 by means of the containing element 4*b* which also acts as a support of the barrier element 4*a* itself. Advantageously, the containing element 4*b* is configured to axially keep apart at least the barrier element 4*a* from the base portion 3*a* of the fan 3 along the rotation axis X at a distance greater than or equal to the distance D between the base portion 3*a* of the fan 3 and the radial plane P, in an operative working configuration of the hairdryer 1.

More in detail, with reference to the FIGS. 1A-2, the barrier element 4*a* is ring-shaped with a central hole 6 so as to allow at least the partial passing of the containing element 4*b*.

In fact, in an embodiment of the present invention, the barrier element 4*a* and the containing element 4*b* are two distinct elements and wherein the containing element 4*b* has a supporting abutment 7 configured to support the barrier element 4*a*.

Figure 1B:
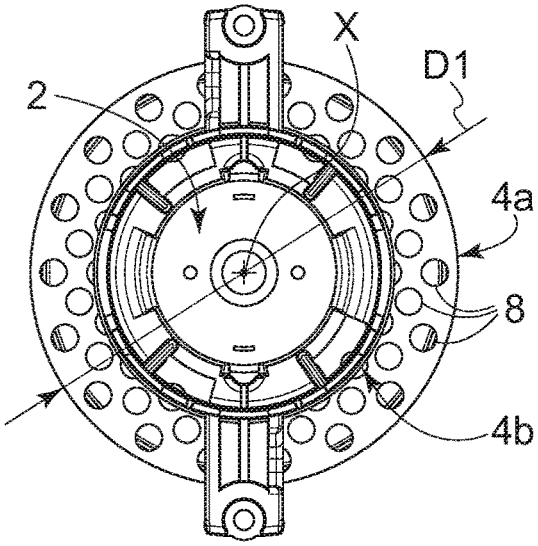
FIG. 1B is a schematic plan view of the hairdryer of FIG. 1A.
Figure 1C:
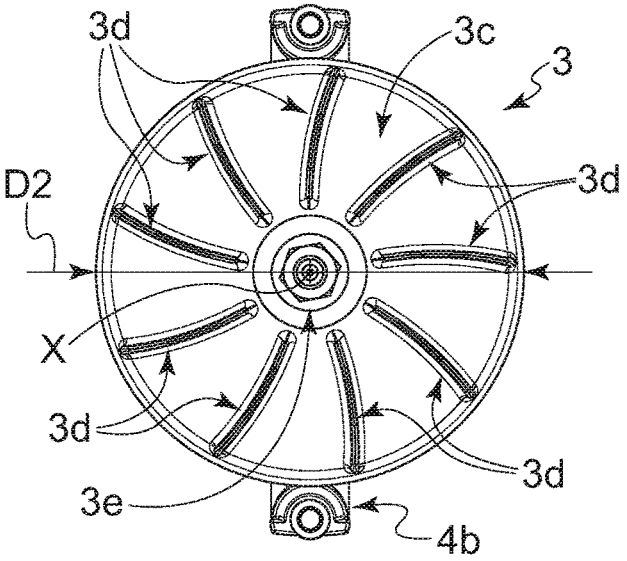
FIG. 1C is a further schematic plan view of the hairdryer of FIG. 1A.

According to the aforesaid embodiment, with reference to the accompanying FIGS. 1A-1C, the base portion 3*a* of the fan 3 preferably has a diameter D2 greater than a diameter of the head portion 3*b* and wherein at least the barrier element 4*a* has an outer diameter D1 between a minimum value of about 20% less than the diameter D2 of the base portion 3*a* and a maximum value of about 20% more than the diameter D2 of the base portion 3*a* of the fan 3.

Preferably, with reference to the accompanying FIG. 1A, the barrier element 4*a* is arranged at a predetermined distance d from the base portion 3*a* of the fan 3. Still more preferably, the aforesaid distance d is between about 2 and 0.1 cm.

Optionally and without any limitations for the present invention, the barrier element 4*a* has a shape slightly tapering from a smaller portion facing the base portion 3*a* of the fan 3 to a bigger portion facing the electric motor 2.

According to the present embodiment, the barrier element 4*a* has at least one hole 8 along the ring-shaped portion, preferably the barrier element 4*a* having a plurality of through holes 8 so as to form a grid.

In a further embodiment of the present invention schematically shown by way of example and without limitations in the accompanying FIGS. 3A-4 and 6A, the protecting device 4 is configured so that the barrier element 4*a* and the containing element 4*b* are made in one piece in a single monolithic element. In other words, the containing element 4*b*, with respect to the embodiment described above, is not as extended and is integral with the barrier element 4*a*.

Figure 4:
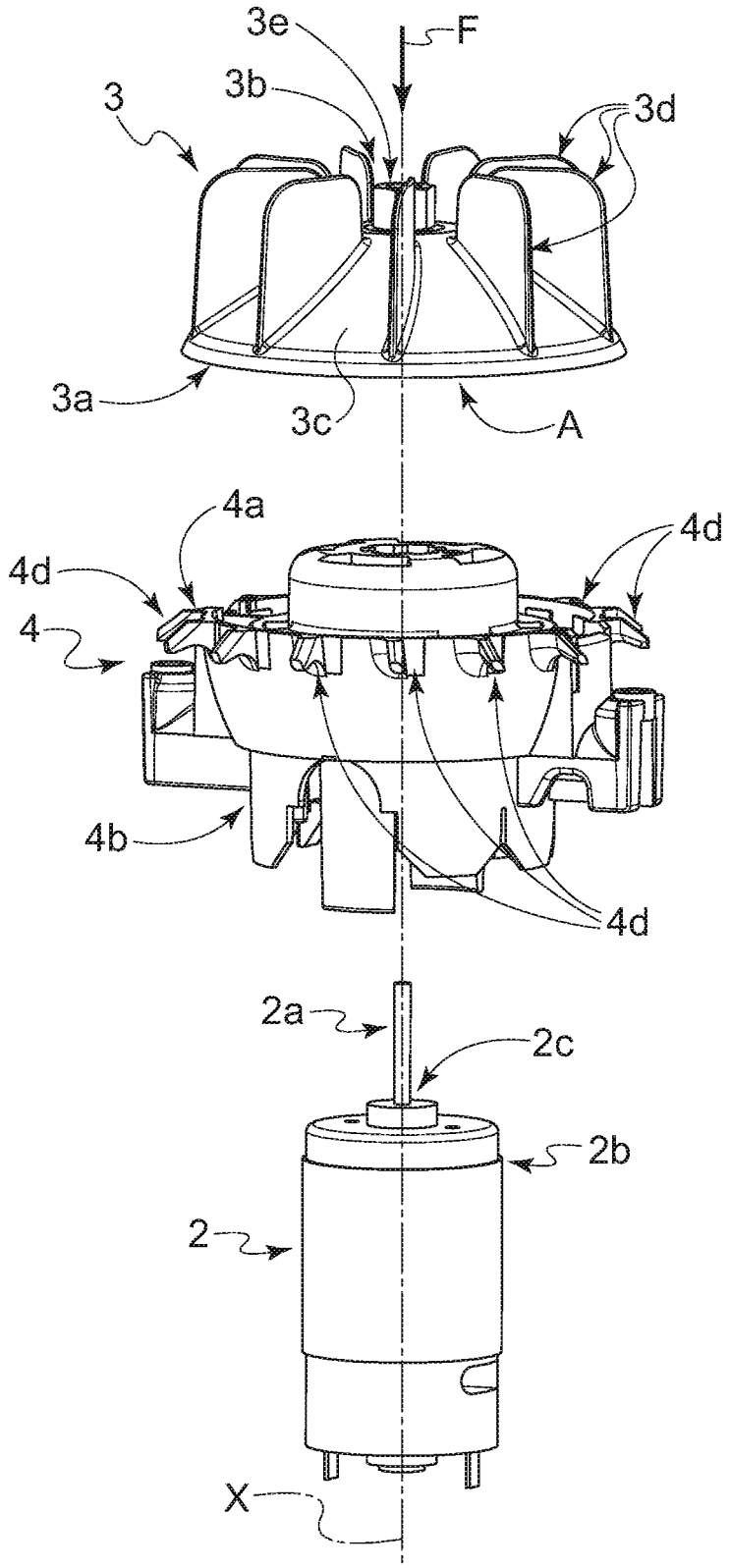
FIG. 4 is an exploded schematic view of the hairdryer of FIG. 3A.
Figure 5:
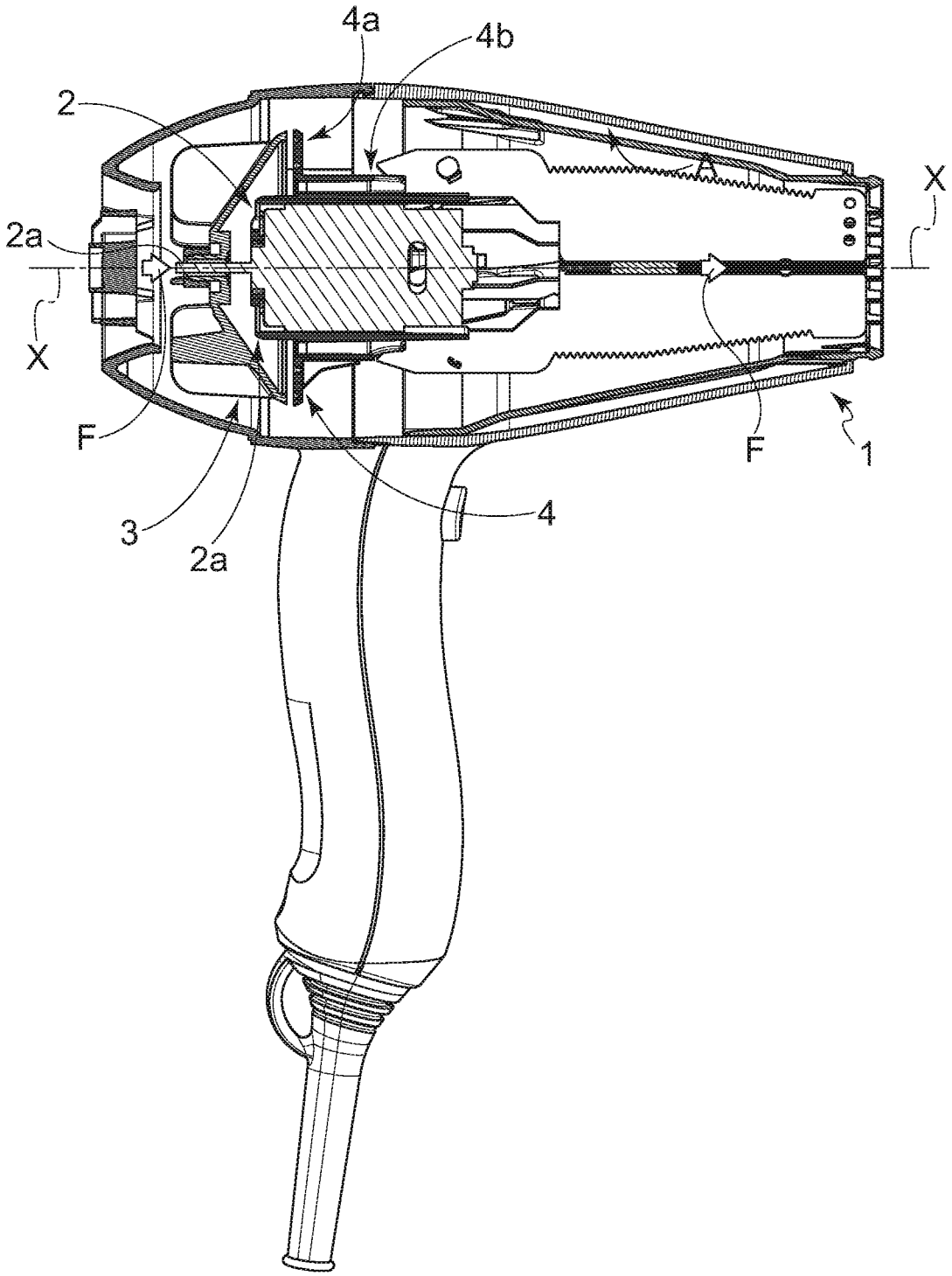
FIG. 5 is a schematic sectional view of the hairdryer according to the present invention.
Figure 6A:
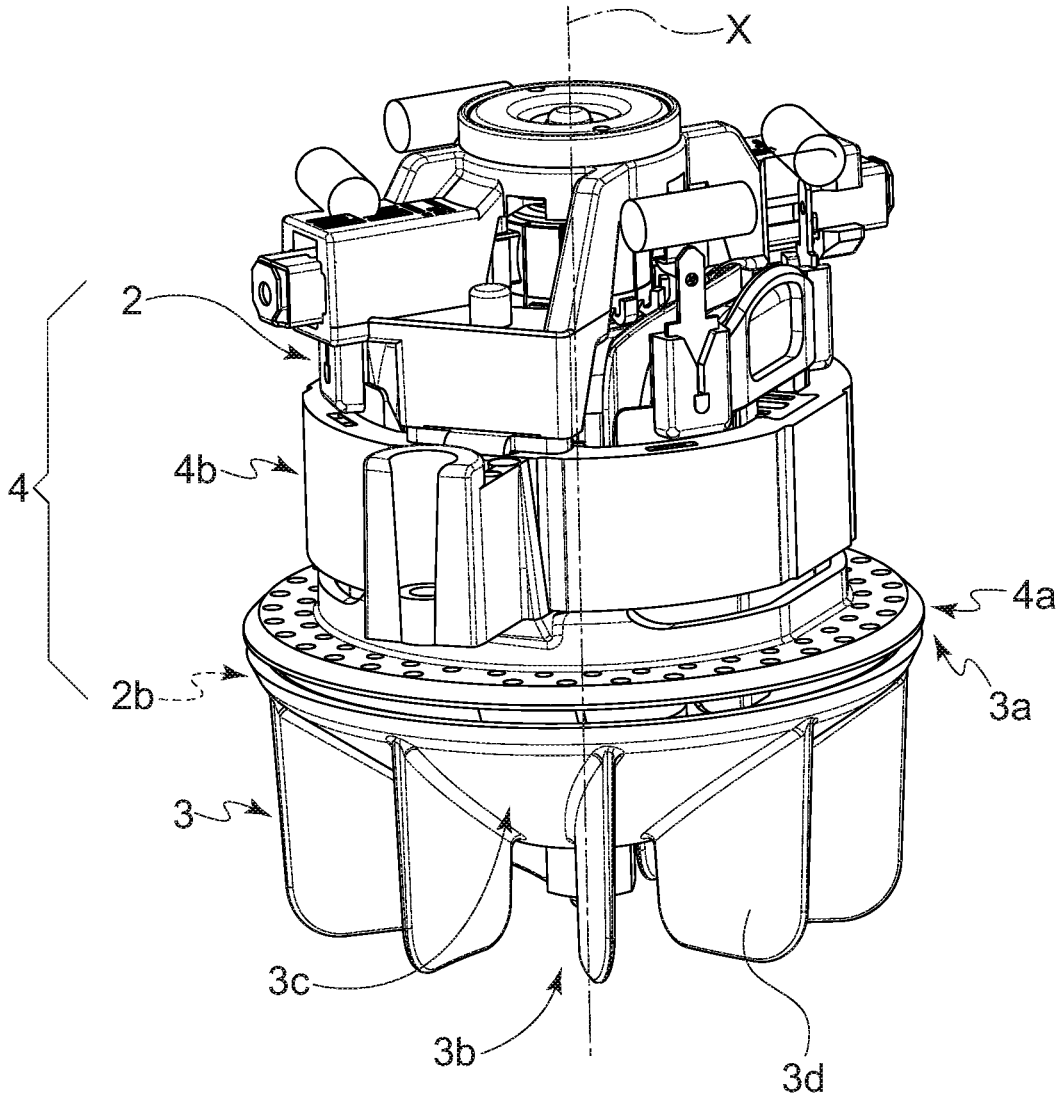
FIG. 6A is a further perspective and schematic view of a part of the hairdryer according to the present invention.
Figure 6B:
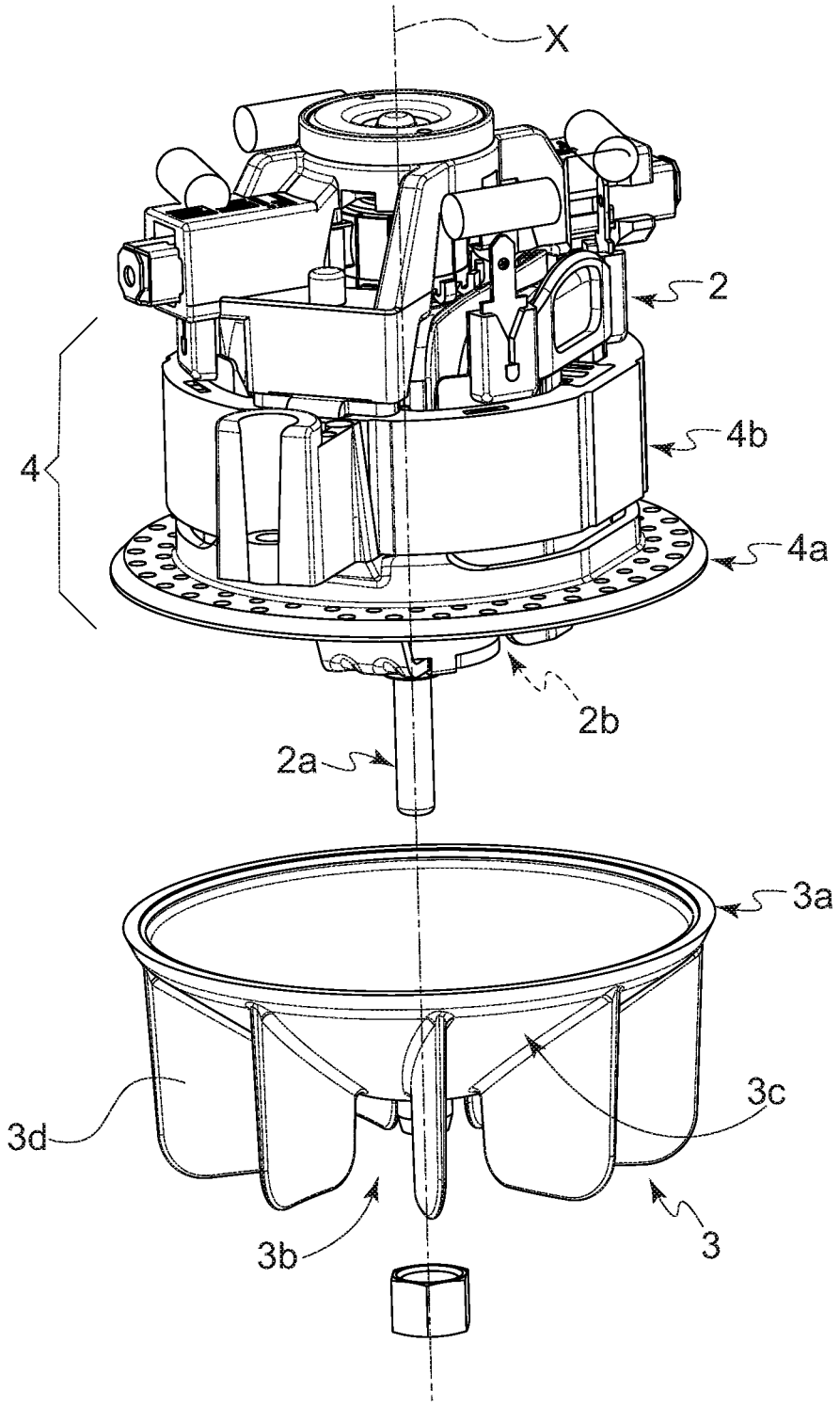
FIG. 6B is an exploded perspective and schematic view of a part of the hairdryer according to the present invention.

In particular, the barrier element 4*a* preferably has an axisymmetric and conical shape tapering from a diametrically smaller portion facing the electric motor 2 to a diametrically bigger portion facing the base portion 3*a* of the fan 3, as can be schematically appreciated in the accompanying FIG. 4.

The barrier element 4*a* has a plurality of hooked protrusions 4*d* so as to radially extend outwardly. Preferably, the hooked protrusions 4*d* are angularly equispaced with respect to the axis X.

In alternative to that which was just described above, without any limitations for the present invention, the barrier element 4*a* has at least one circular sector having an opening so as to extend about 30° angularly, preferably 20°, with respect to the rotation axis X to allow the outflow of air and to protect the hairdryer 1 from the intrusion of hair in an operative working condition thereof. This optional solution of the barrier element 4*a* is not shown in the accompanying figures.

With reference to that which was described above for the different configurations of the barrier element 4*a*, it should be noted that both the number/sizes and pitch of the holes 8 and the distribution of the hooked protrusions 4*d* are defined so that to allow a partial and predetermined passage for the air flow F of the fan 3.

In order to provide, by way of example and without limitations, an indicative parameter of reference of the distribution of the holes or necessary protrusions, the partial flow crossing the barrier element 4*a* must not be heavy such as to cause the passage of hair beyond such element in an operative use configuration of the hairdryer 1 when the delivery mouth is obstructed.

According to a further and different embodiment of the present invention, not shown in the accompanying figures, the hairdryer 1 further comprises a containing shell wherein at least the protecting device 4 is configured to be reversibly hooked to the containing shell and wherein the protecting device 4 can be defined by means of a passage port between the containing element 4*b* and an inner wall of the aforesaid containing shell. This way, the protecting device 4 is placed at a distance from the fan 3 greater than or equal to a distance D between the fan itself and the radial plane P.

Preferably, at least the barrier element 4*a* and the containing element 4*b* are made of plastic material resistant to high temperatures, for example ABS or PA, in each embodiment of the present invention. In alternative, at least the barrier element 4*a* is made of metal.

The present invention has achieved the preset purposes.

Advantageously, the hairdryer of the present invention has an inner structure with a protecting device so as to be able to trap the hair sucked in by depressions or flow inversions due to a particular use of the hairdryer, such as the professional one, for example while hair setting.

Advantageously, the present hairdryer comprises a protecting device which traps foreign bodies at a predetermined distance from the motor shaft and fan, i.e. very far away from the hub of the fan and from the bearing of the electric motor, a characteristic which hairdryers of the known type do not have.

Advantageously, the present invention provides a safe and reliable hairdryer.

Advantageously, the present invention provides a hairdryer with simplified and easy to maintain and clean structure.

Advantageously, the present invention provides a professional hairdryer appreciated for its ease of use and scarce need of maintenance as well as for its high safety, also in the more demanding use conditions of professional hairdressers and stylists.

The invention claimed is:

1. Electric hairdryer (1), comprising:

an electric motor (2) for an electric hairdryer provided with a motor shaft (2*a*) rotatable around a rotation axis (X);

a fan (3) operatively combined with said motor shaft (2*a*) and having a base portion (3*a*) and a head portion (3*b*) opposite said base portion (3*a*) and a supporting body (3*c*) extending between the two portions (3*a*, 3*b*);

a protecting device (4) to protect the electric motor (2), comprising at least one barrier element (4*a*) configured to intercept unwanted objects inside said hairdryer (1);

an internally hollow containing element (4*b*) and having an opening (4*c*) for housing at least partially said electric motor (2);

characterized in that said electric motor (2) comprises a zone (2*b*) facing said fan (3) wherein said motor shaft (2*a*) comes out of said electric motor (2) to extend along the rotation axis (X); said zone (3*b*) identifying a radial plane (P); said protecting device (4) being placed at least partially around said rotation axis (X) at a distance from said base portion (3*a*) of said fan (3) greater than or equal to the distance (D) between said base portion (3*a*) of said fan (3) and said radial plane (P).

2. Hairdryer (1) according to claim 1, wherein said radial plane (P) is substantially orthogonal to said rotation axis (X) of the motor shaft (2*a*) and passes at a flanged portion of said zone (2*b*) of said electric motor (2) in an operative working configuration of said hairdryer (1).

3. Hairdryer (1) according to claim 1, wherein said containing element (4*b*) is configured to axially keep apart at least said barrier element (4*a*) from said base portion (3*a*) of the fan (3) along the rotation axis (X) at a distance greater than or equal to the distance (D) between said base portion (3*a*) of the fan (3) and said radial plane (P) in an operative working configuration of said hairdryer (1).

4. Hairdryer (1) according to claim 1, wherein said barrier element (4*a*) is ring-shaped with a central hole (6) so as to at least allow the partial passing of said containing element (4*b*).

5. Hairdryer (1) according to claim 1, wherein said barrier element (4*a*) and said containing element (4*b*) are two distinct elements and wherein said containing element (4*b*) has a supporting abutment (7) configured to support said barrier element (4*a*).

6. Hairdryer (1) according to claim 1, wherein said protecting device (4) is configured so that said containing element (4*b*) is interposed between said barrier element (4*a*) and said electric motor (2) in a radial direction with respect to said rotation axis (X) in an operative working configuration of said hairdryer (1).

7. Hairdryer (1) according to claim 1, wherein said base portion (3*a*) of the fan (3) has a diameter (D2) greater than the diameter of said head portion (3*b*) and wherein at least said barrier element (4*a*) has an outer diameter (D1) between a minimum value of about 20% less than said diameter (D2) of the base portion (3*a*) and a maximum value of about 20% more than said diameter (D2) of the base portion (3*a*).

8. Hairdryer (1) according to claim 1, wherein said barrier element (4*a*) has at least one hole along the ring-shaped portion.

9. Hairdryer (1) according to claim 1, wherein said protecting device (4) is configured so that said barrier element (4*a*) and said containing element (4*b*) are made in one piece in a single monolithic element.

10. Hairdryer (1) according to claim 9, wherein said barrier element (4*a*) has an axisymmetric and conical shape tapering from a diametrically smaller portion facing the electric motor (2) to a diametrically bigger portion facing said base portion (3*a*) of the fan (3).

11. Hairdryer (1) according to claim 9, wherein said barrier element (4*a*) has a plurality of hooked protrusions (4*d*) so as to radially extend outwardly, preferably said hooked protrusions (4*d*) being angularly equispaced.

12. Hairdryer (1) according to claim 9, wherein said barrier element (4*a*) has at least one circular sector having an opening so as to extend about 30° angularly with respect to said rotation axis (X) in order to allow the outflow of air and to protect said hairdryer (1) from the intrusion of hair in an operative working condition of the hairdryer (1) itself.

13. Hairdryer (1) according to claim 8, wherein said barrier element (4*a*) having a plurality of through holes (8) so as to form a grid.

* * * * *